US011265662B2

(12) United States Patent
Nielsen et al.

(10) Patent No.: US 11,265,662 B2
(45) Date of Patent: Mar. 1, 2022

(54) HEARING AID COMPRISING A LOOP ANTENNA

(71) Applicant: GN HEARING A/S, Ballerup (DK)

(72) Inventors: Henrik Nielsen, Roskilde (DK); Søren Kvist, Værløse (DK)

(73) Assignee: GN HEARING A/S, Ballerup (DK)

( * ) Notice: Subject to any disclaimer, the term of this patent is extended or adjusted under 35 U.S.C. 154(b) by 18 days.

(21) Appl. No.: 16/553,170

(22) Filed: Aug. 27, 2019

(65) Prior Publication Data

US 2020/0107142 A1 Apr. 2, 2020

(30) Foreign Application Priority Data

Sep. 28, 2018 (EP) ..... 18197730

(51) Int. Cl.
*H04R 25/00* (2006.01)
*H01Q 1/27* (2006.01)
*H01Q 7/00* (2006.01)

(52) U.S. Cl.
CPC ..... *H04R 25/554* (2013.01); *H01Q 1/273* (2013.01); *H01Q 7/00* (2013.01); *H04R 25/602* (2013.01); *H04R 25/609* (2019.05); *H04R 25/65* (2013.01); *H04R 2225/023* (2013.01); *H04R 2225/025* (2013.01); *H04R 2225/51* (2013.01)

(58) Field of Classification Search
CPC combination set(s) only.
See application file for complete search history.

(56) References Cited

U.S. PATENT DOCUMENTS 5,003,608 A * 3/1991 Carlson ..... H04R 25/00 381/329
5,721,783 A * 2/1998 Anderson ..... H04B 1/385 381/328
6,055,319 A * 4/2000 Shennib ..... H04R 25/00 379/52
6,529,609 B1 * 3/2003 Neilson ..... H04R 25/65 379/52

(Continued)

FOREIGN PATENT DOCUMENTS

EP 3 116 238 A1 1/2017
JP 2007-013247 1/2007

(Continued)

OTHER PUBLICATIONS

Extended European Search Report dated Mar. 19, 2019 for corresponding European Application No. 18197730.7.

*Primary Examiner* — Angelica M McKinney
(74) *Attorney, Agent, or Firm* — Vista IP Law Group, LLP

(57) ABSTRACT

The hearing aid includes an end wall having end face adapted to face outwards of an ear canal when the hearing aid is placed in the ear canal, and the hearing aid includes an antenna extending from the end face and having two legs inserted into the end wall and electrically coupled to wireless circuitry arranged inside the hollow housing. Each leg of the antenna is provided with a first coupling part releasably engaging a corresponding second coupling part of the hollow housing, and at least one locking part is movable between a locking position in which the first coupling parts are locked to the corresponding second coupling parts and a release position in which the first coupling parts are free to be removed from the corresponding second coupling parts.

23 Claims, 12 Drawing Sheets

(56) References Cited

U.S. PATENT DOCUMENTS

| | | | | |
|---|---|---|---|---|
| 8,280,090 | B2 * | 10/2012 | Parsi | H04R 25/60 381/329 |
| 9,445,206 | B2 * | 9/2016 | Sundberg | H04R 25/602 |
| 2005/0168396 | A1 * | 8/2005 | Victorian | H01Q 7/00 343/788 |
| 2010/0020994 | A1 * | 1/2010 | Christensen | H04R 25/554 381/315 |
| 2010/0202644 | A1 * | 8/2010 | Angst | H04R 25/602 381/323 |
| 2010/0290655 | A1 * | 11/2010 | Takeda | H04R 25/602 381/323 |
| 2014/0177893 | A1 * | 6/2014 | Lu | H04R 25/556 381/323 |
| 2018/0084351 | A1 * | 3/2018 | Polinske | H04R 25/554 |
| 2019/0166437 | A1 * | 5/2019 | Adel | H04R 25/602 |
| 2020/0107141 | A1 * | 4/2020 | Kvist | H01Q 9/00 |

FOREIGN PATENT DOCUMENTS

| | | | |
|---|---|---|---|
| JP | 2007 013247 | A | 1/2007 |
| WO | WO 2018/024392 | A1 | 2/2018 |

* cited by examiner

HEARING AID COMPRISING A LOOP ANTENNA

RELATED APPLICATION DATA

This application claims priority to, and the benefit of, European Patent Application No. 18197730.7 filed on Sep. 28, 2018. The entire disclosure of the above application is expressly incorporated by reference herein.

BACKGROUND

The present disclosure relates to a hearing aid comprising a hollow housing having a custom-made outer shell conforming to an ear canal shape of a user and an end wall having end face adapted to face outwards of an ear canal when the hearing aid is placed in the ear canal, and the hearing aid comprising a loop antenna extending from the end face and having two legs inserted into the end wall and electrically coupled to wireless circuitry arranged inside the hollow housing.

US 2018/0084351 A1 discloses a hearing aid antenna. The hearing aid is configured to be worn in an ear of a wearer and to perform wireless communication. The hearing aid includes a housing, hearing electronics within the housing, and an inverted F antenna or a loop antenna disposed at least partially in the housing. A portion of the F antenna or loop antenna may protrude from an exterior of the housing and the antenna may be part of a removal handle or string. However, depending on the precise location of the hearing aid in the ear canal, high or deep, wireless performance of the antenna may vary. Additionally, depending on the location of the hearing aid in the ear canal, ease of use of the antenna as a removal handle or string may vary.

Pull out wires are usually glued into the faceplate of a custom-made housing of a hearing aid. Due to manufacturing processes and operator skills, the quality and robustness of the connection between the pull out wire and the faceplate may vary. Manufacturing of a hearing aid and mounting of an external loop antenna in a consistent way to achieve predictable wireless performance may likewise be difficult due to small dimensions, limited space, drilling and gluing tolerances and varying faceplate geometries. Consequently, obtaining an optimum mounting of the loop antenna may present a challenge even for experienced technicians. Furthermore, in the case of repairing an existing hearing aid, the challenges may be similar and disassembling may be even more challenging, in particular if the pull out wire or antenna is glued into the faceplate.

SUMMARY

One object is to provide a hearing aid with an antenna, whereby wireless performance and/or handling properties may be adapted to actual requirements in the situation of use.

In view of this object, each leg of the loop antenna is provided with a first coupling part releasably engaging a corresponding second coupling part of the hollow housing. At least one locking part of the hearing aid is movable between a locking position in which the first coupling parts are locked to the corresponding second coupling parts and a release position in which the first coupling parts are removable from the corresponding second coupling parts. Consequently, in the release position, the first coupling parts and second coupling parts can be disconnected and removed without imparting any physical damage to the first and second coupling parts and any damage to other portions of the hearing aid.

In this way energy efficiency of the antenna and the handling properties of the hearing aid may easily be optimised to user requirements—for example by selecting a specific antenna design or dimensions for a certain RF range by mounting the antenna in the hearing aid without use of any special tools. The choice of the specific antenna design or variant may depend on the specific wireless standard, such as Bluetooth, Bluetooth LE, Wi-Fi or any proprietary standard, the shape of the ear canal, the position of the hearing aid in the ear canal, and the dexterity of the user, among others. Furthermore, the antenna may easily be replaced by a different type at a later stage as needed.

In a structurally particularly advantageous embodiment, an opening is formed in the end wall and is defined by a surrounding wall, the second coupling parts are arranged in the opening, and the at least one locking part has the form of an element adapted to, in the locking position of the locking part, be inserted into the opening. Thereby, the legs of the loop antenna may in a simple an intuitive way be locked to the hearing aid.

In an embodiment, the second coupling parts are arranged at the surrounding wall defining the opening.

In an embodiment, the second coupling parts have the form of recesses in the surrounding wall defining the opening.

In an embodiment, the recesses have the form of a partly at least substantially cylindrical channel having a restriction or a recess at a longitudinal position of the channel, and the first coupling parts have a corresponding partly at least substantially cylindrical form with a recess or a thickening corresponding to the restriction or recess of the partly cylindrical channel. Thereby, the restriction or recess engaging the corresponding recess or thickening may serve to avoid displacement of the loop antenna in the longitudinal direction of the legs of the loop antenna.

In an embodiment, first coupling parts have the form of protrusions from the legs of the loop antenna adapted to engage the recesses forming the second coupling parts so that the protrusions, in their engaged position, are at least substantially flush with the surrounding wall defining the opening. The protrusions being at least substantially flush with the surrounding wall may for instance facilitate integration of the coupling parts in a battery compartment wherein the locking part has the form of a hinged battery door.

In an embodiment, the opening forms the entrance of a battery compartment and the locking part has the form of a battery door hinged to the end wall and being swingable between a closed position and an open position. Thereby, in the case of a hearing aid having a battery compartment, a separate locking element for the loop antenna may be dispensed with. Furthermore, the operation of locking the loop antenna to the hearing aid may be facilitated and may already be familiar to the user.

In an embodiment, a hinge axis of the battery door separates the battery door into a main door part swinging away from the battery compartment when the battery door is opened and an auxiliary door part swinging into the battery compartment when the battery door is opened, and the auxiliary door part is adapted to lock the first coupling parts to the corresponding second coupling parts in the closed position of the battery door. Thereby, the coupling parts for locking the loop antenna to the hearing aid may not interfere with the opening through which the battery is inserted into the battery compartment and may therefore not obstruct normal use of the hearing aid.

In an embodiment, the opening is at least substantially rectangular and is defined by four wall parts, and the second coupling parts have the form of recesses arranged at neighbouring corners of the opening and defines insertion directions for the respective first coupling parts being oblique in relation to the extension of each wall part defining the rectangular opening. Thereby, the insertion of the first coupling parts into the respective second coupling parts may cause a certain flexion of the loop antenna, thereby providing an additional locking function whereby the loop antenna may be fixed in place already before moving the locking part to its locking position. Furthermore, at the corners of the opening, suitable material thickness may be present in order to form the recesses forming the second coupling parts.

In an embodiment, the respective first and second coupling parts are mutually arranged in such a way that the loop antenna has to flex when the first coupling parts are brought into engagement with the second coupling parts. Thereby, an additional locking function may be provided whereby the loop antenna may be fixed in place already before moving the locking part to its locking position.

In an embodiment, the locking part has the form of locking block adapted to, in the locking position of the locking block, form a snap lock with the first coupling parts and/or with the opening formed in the end wall. Thereby, an additional locking function may be provided, thereby even better securing the loop antenna to the hollow housing of the hearing aid.

In an embodiment, the loop antenna has the form of or incorporates a thin wire or cable, and the loop antenna is provided with a gripping element in the form of a thickening, such as a ball-formed element or the like. Thereby, handling of the hearing aid may be facilitated.

In an embodiment, the hearing aid is of the in-the-ear type (ITE). In an embodiment, the hearing aid is of the in-the-canal type (ITC). In an embodiment, the hearing aid is of the completely-in-the-canal type (CIC). The end face of the end wall facing outwardly of the user's ear canal when the hearing aid is mounted therein may comprise a faceplate or may be formed integrally with the custom-made outer shell using well-known additive manufacturing technologies.

The present embodiments further relate to a method of mounting a loop antenna on a hearing aid comprising a hollow housing having a custom-made outer shell conforming to an ear canal shape of a user and an end wall having end face adapted to face outwards of an ear canal when the hearing aid is placed in the ear canal, whereby the loop antenna is arranged extending from the end face and has two legs being inserted into the end wall and being electrically coupled to wireless circuitry arranged inside the hollow housing.

The method is characterised by bringing a first coupling part of each leg of the loop antenna releasably into engagement with a corresponding second coupling part of the hollow housing, and by moving at least one locking part from a release position in which the first coupling parts are free to be removed from the corresponding second coupling parts to a locking position in which the first coupling parts are locked to the corresponding second coupling parts. Thereby, the above-mentioned features may be obtained.

In an embodiment, a specific loop antenna is selected from a number of different loop antennas having differing properties relating to wireless performance and/or having differing properties relating to handling of the hearing aid when gripping the loop antenna, and said specific loop antenna is mounted on the hearing aid. Thereby, the above-mentioned features may be obtained.

BRIEF DESCRIPTION OF THE DRAWINGS

Embodiments will be described in more detail in connection with the appended very schematic drawings, in which.

DESCRIPTION OF PREFERRED EMBODIMENTS

Figure 1:
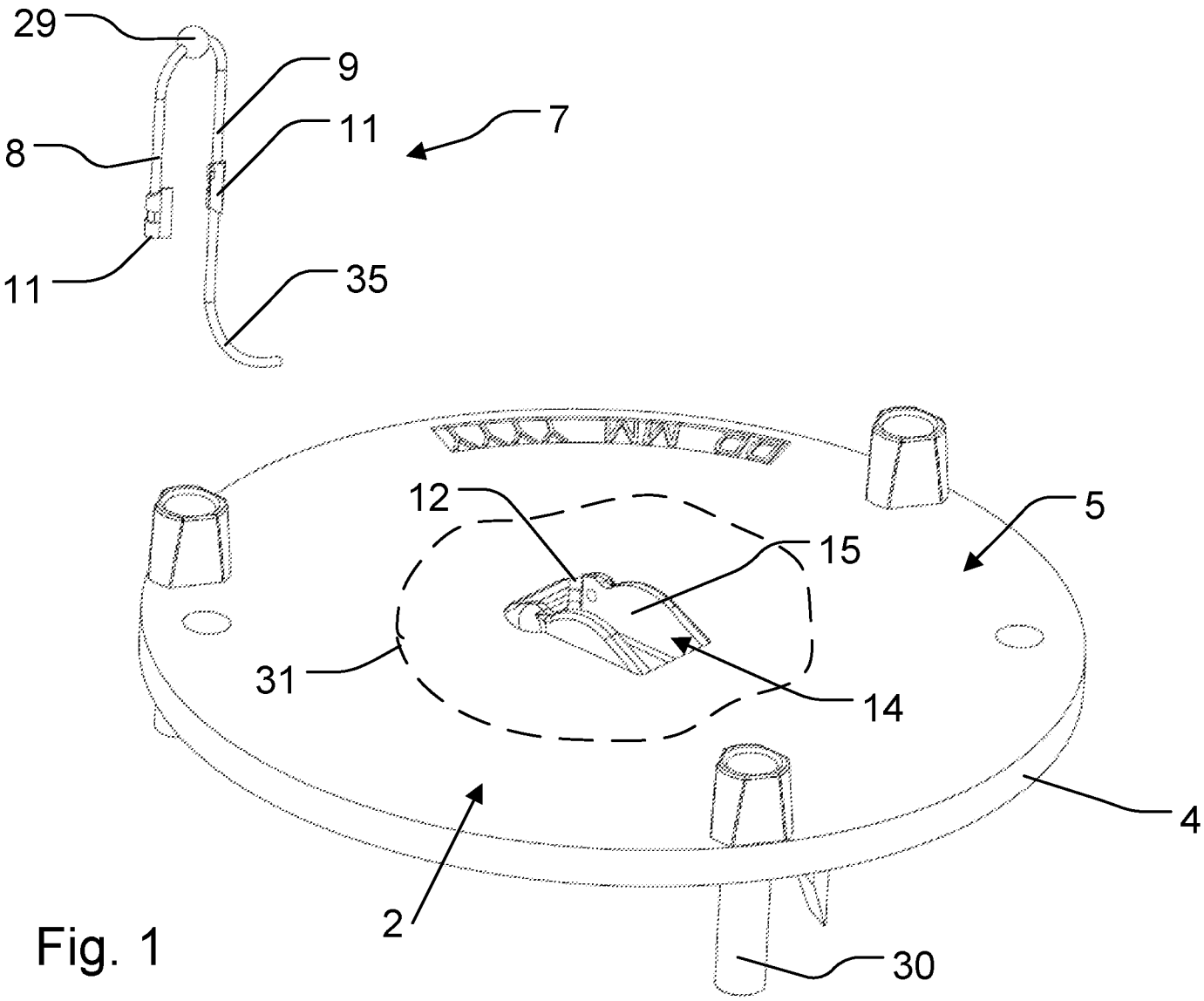
FIG. 1 is a perspective view of a faceplate for a hearing aid with a battery compartment and a loop antenna according to some embodiments, before insertion of the loop antenna into the battery compartment.
Figure 2:
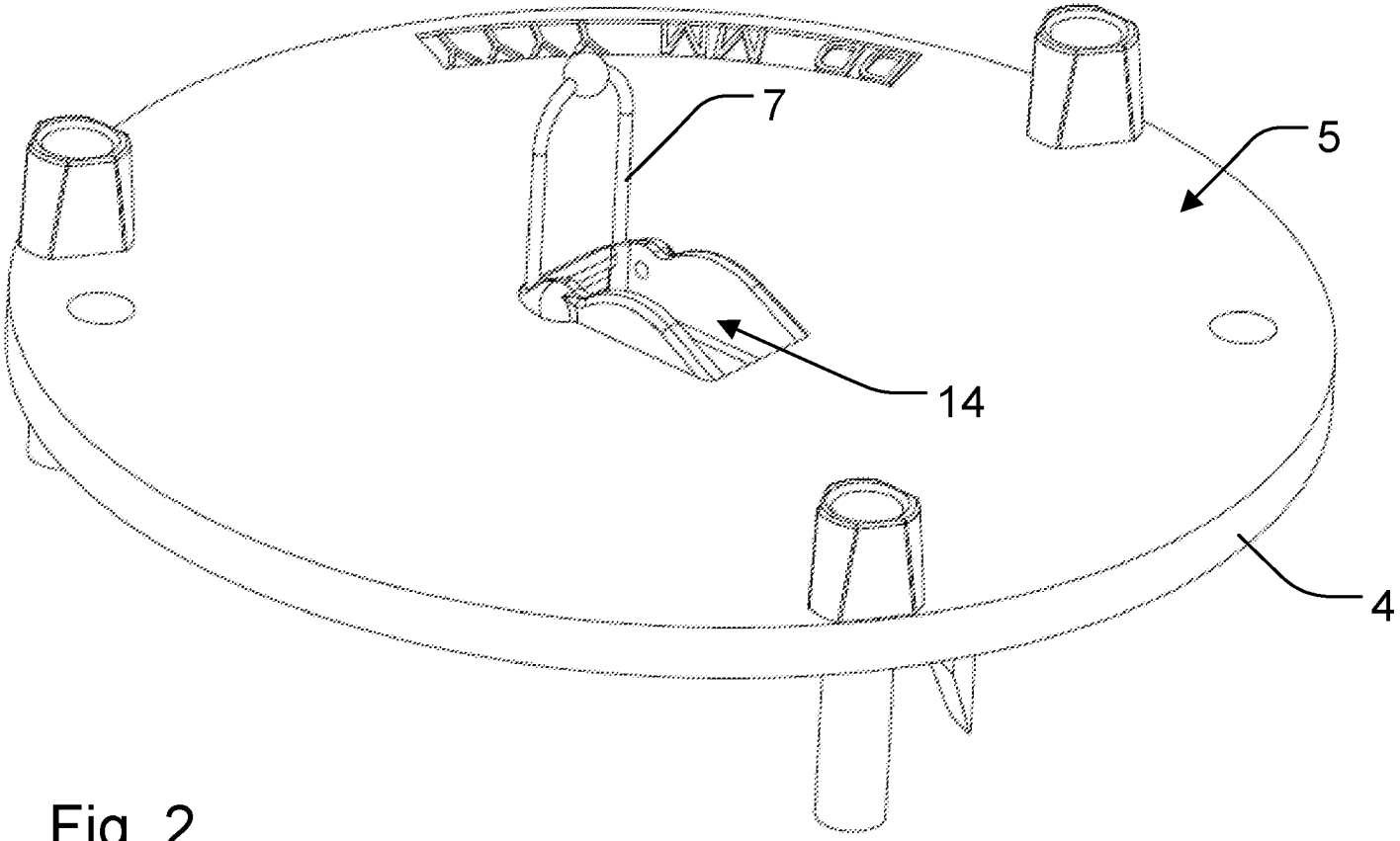
FIG. 2 is a view corresponding to that of FIG. 1, after insertion of the loop antenna into the battery compartment, but before mounting a battery door.
Figure 3:
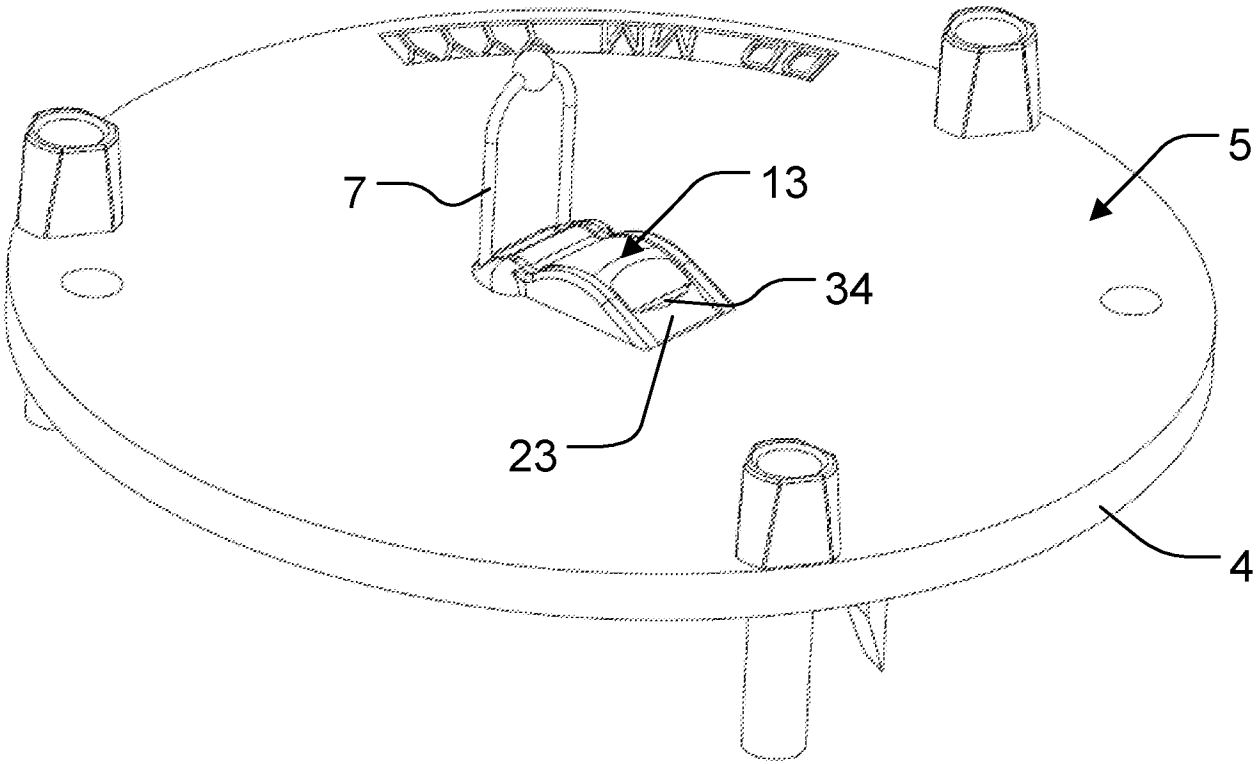
FIG. 3 is a view corresponding to that of FIG. 2, after mounting and closing a battery door.
Figure 16:
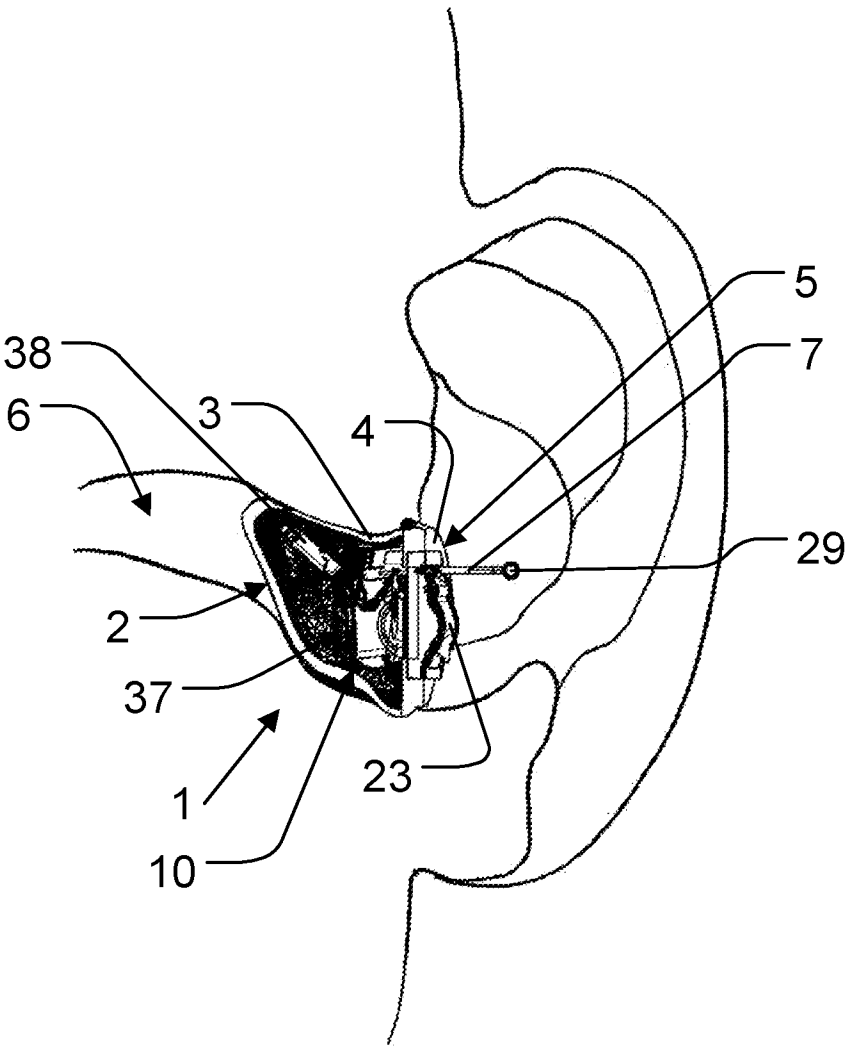
FIG. 16 illustrates a cross-sectional view through an ear canal with a hearing aid according to some embodiments inserted into the ear canal.

FIG. 1 shows an end wall 4 in the form of a so-called faceplate for a hearing aid 1 illustrated in FIG. 16. The hearing aid 1 may for instance be a completely-in-the-canal type (CIC), an in-the-canal type (ITC), or an in-the-ear type (ITE). However, as it will be understood from this description, the advantages of the present embodiments are particularly pronounced when the hearing aid is of a type that is placed relatively deep in the ear canal. In this case, with prior art hearing aids, wireless performance of the antenna may be a challenge due to the flesh surrounding the user's ear canal. Furthermore, with prior art hearing aids, ease of use of the antenna as a removal handle may be challenging.

The faceplate illustrated has been manufactured in a standard size and is provided with fixation and positioning elements 30. Referring to FIG. 16, the hearing aid 1 includes a hollow housing 2 having a custom-made outer shell 3 conforming to an ear canal shape of a user. Subsequently, when the faceplate has been mounted on the custom-made hollow housing 2, it is cut into a shape conforming to the hollow housing as indicated by the dashed line 31 of FIG. 1. The end wall 4 formed by the faceplate has an end face 5 adapted to face outwards of an ear canal 6 when the hearing aid 1 is placed in the ear canal as illustrated in FIG. 16.

As illustrated in FIGS. 1 to 9, the hearing aid 1 comprises a loop antenna 7 extending from the end face 5 and having two legs 8, 9 inserted into the end wall 4. Each leg 8, 9 is electrically coupled to wireless electronics circuitry 10 arranged inside the hollow housing 2 as illustrated in FIG. 16. The hollow housing 2 further includes amplifying electronics 37 and a loudspeaker or receiver 38. Furthermore, each leg 8, 9 of the loop antenna 7 is provided with a first coupling part 11 releasably engaging a corresponding second coupling part 12 of the hollow housing 2, and a locking part 13 in the form of a battery door 23 is hinged to the end wall 4 so that it is swingable between a closed position and an open position and thereby movable between a locking position in which the first coupling parts 11 are locked to the corresponding second coupling parts 12 and a release position in which the first coupling parts 11 are free to be removed from the corresponding second coupling parts 12. To facilitate handling, the battery door 23 is provided with a nail grip 34.

As seen in the figures, an opening 14 forming the entrance of a battery compartment 22 is formed in the end wall 4 and is defined by a surrounding wall 15, wherein the second coupling parts 12 are arranged in the opening 14. The locking part 13 in the form of the battery door 23 is adapted to, in the locking position of the locking part, be inserted into the opening 14.

Figure 8:
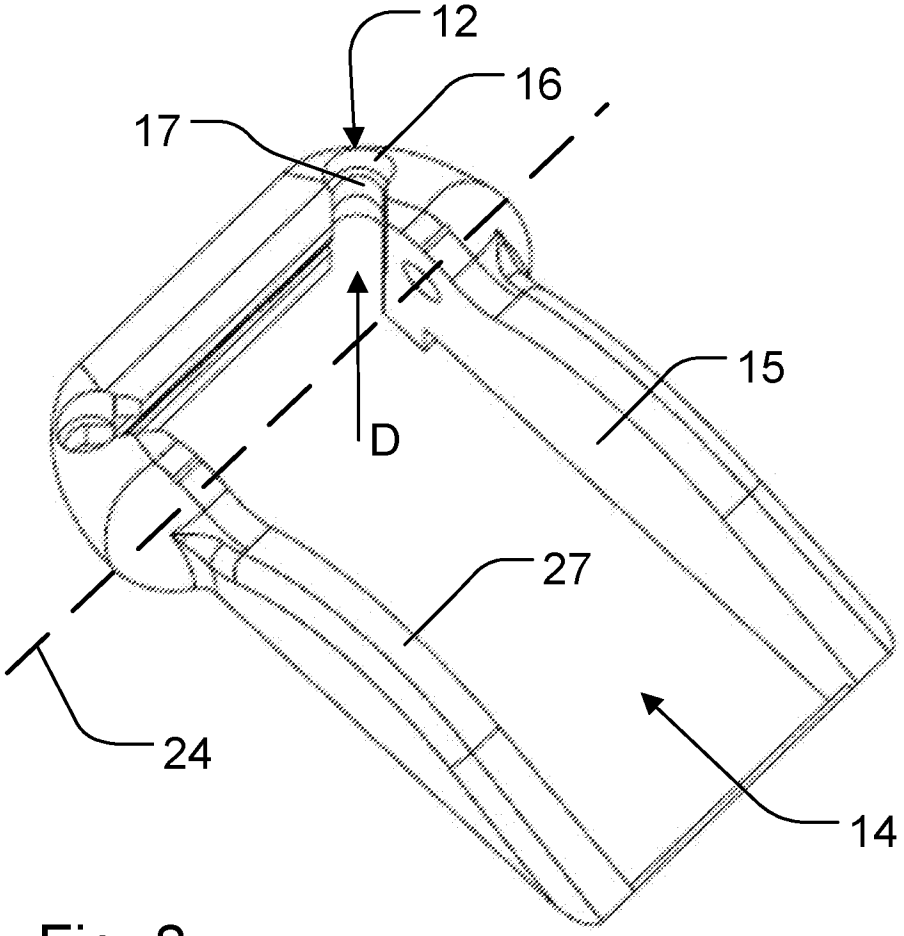
Figure 7:
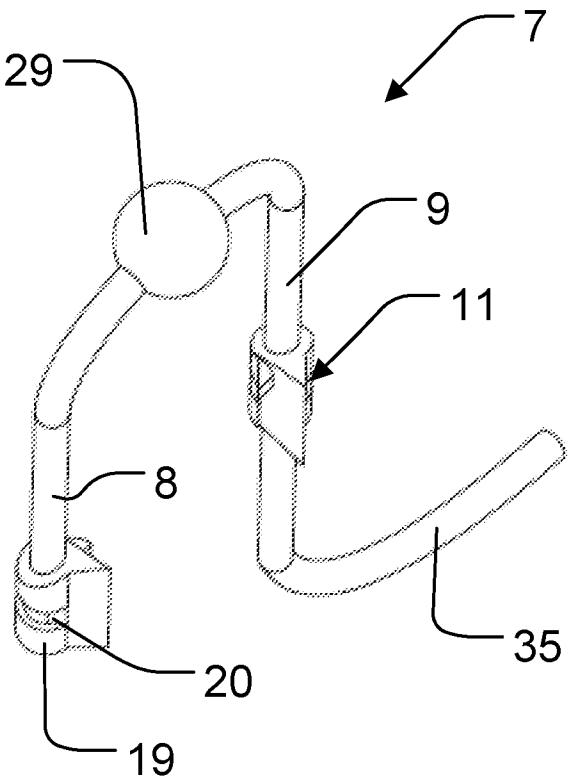

As particularly well seen in FIG. 8, the second coupling parts 12 are arranged at the surrounding wall 15 defining the opening 14, in the form of recesses in the surrounding wall 15. Furthermore, it is seen in FIGS. 7 and 8 that the recesses have the form of a partly cylindrical channel 16 having a restriction 17 at a longitudinal position of the channel, and the first coupling parts 11 have a corresponding partly cylindrical form 19 with a recess 20 corresponding to the restriction 17 of the partly cylindrical channel 16. Suitably, the partly cylindrical form 19 of the first coupling parts 11 may have the form of an over-mould on the legs 8, 9 of the loop antenna 7, and the recess 20 may have the form of an opening in the over-mould providing access to an electrically conducting leader of the loop antenna 7. In this case, the restriction 17 of the partly cylindrical channel 16 may form a contact element providing electrical connection between said electrically conducting leader of the loop antenna 7 and the wireless circuitry 10 arranged inside the hollow housing 2. Of course, said electrical connection may also be provided in any other suitable way. The engagement between restriction 17 and the recess 20 may ensure that the loop antenna 7 may be fixed against displacement in the longitudinal direction of its legs 8, 9. Of course, a suitable engagement between the first coupling parts 11 and the respective second coupling parts 12 may be achieved by many other alternative geometries of the coupling parts 11, 12.

Figure 9:
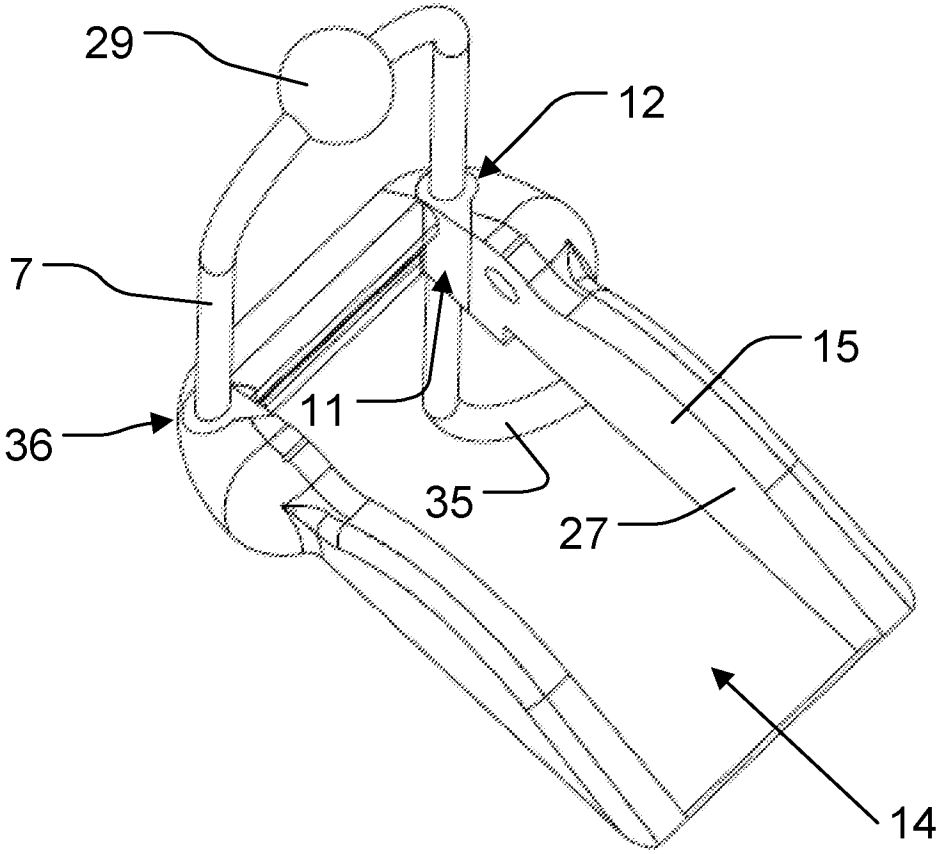
FIG. 9 illustrates the battery compartment and loop antenna of FIGS. 7 and 8, respectively, whereby the loop antenna has been inserted into the battery compartment.

As particularly well seen in FIG. 9, in the illustrated embodiment, the first coupling parts 11 have the form of protrusions from the legs 8, 9 of the loop antenna 7 adapted to engage the recesses forming the second coupling parts 12 so that the protrusions, in their engaged position, are flush with the surrounding wall 15 defining the opening 14. The first coupling parts 11 may generally suitably be produced as over-moulds on a string-formed part forming the loop antenna 7 itself.

Figure 4:
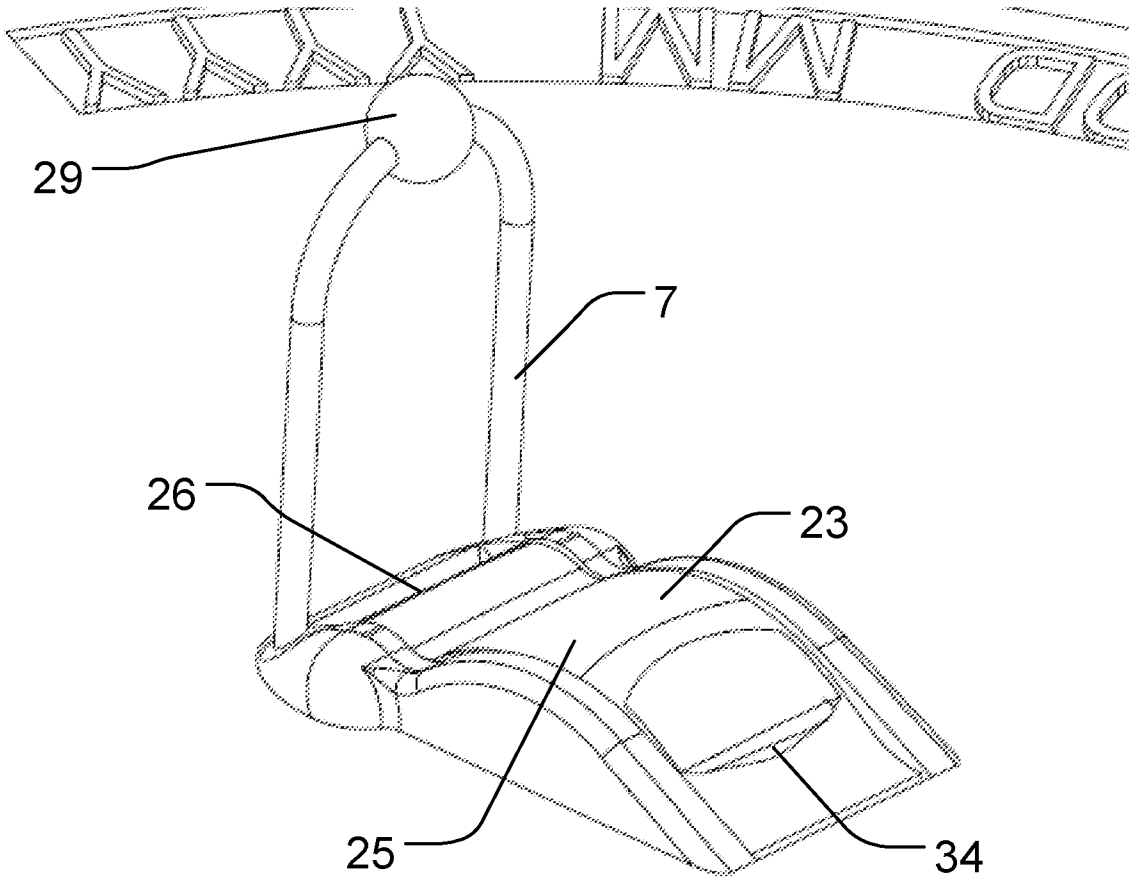
FIG. 4 illustrates the loop antenna and battery compartment of FIG. 3, with closed battery door, on a larger scale.
Figure 6:
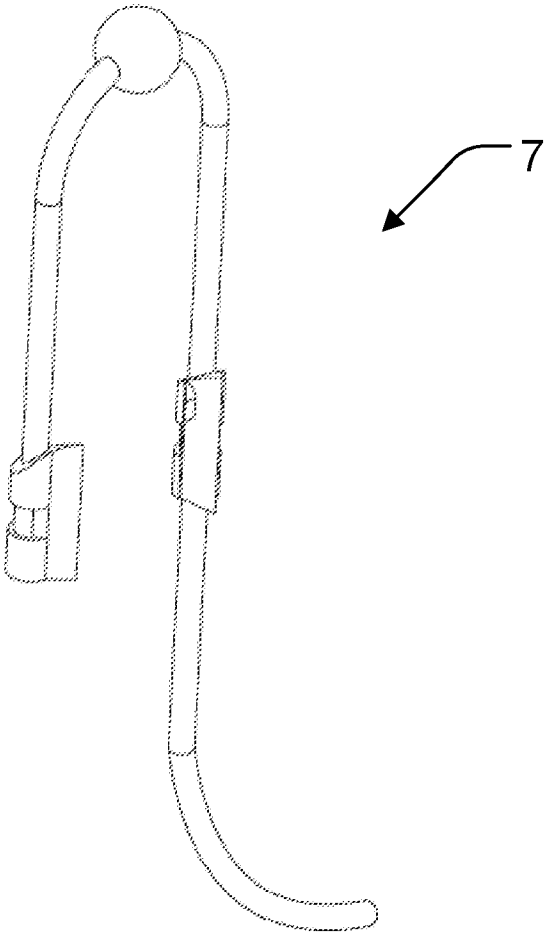
FIG. 6 illustrates the loop antenna of FIG. 4, FIGS. 7 and 8 illustrate, respectively, the loop antenna and battery compartment of FIGS. 5 and 6, seen from a different point of view.
Figure 5:
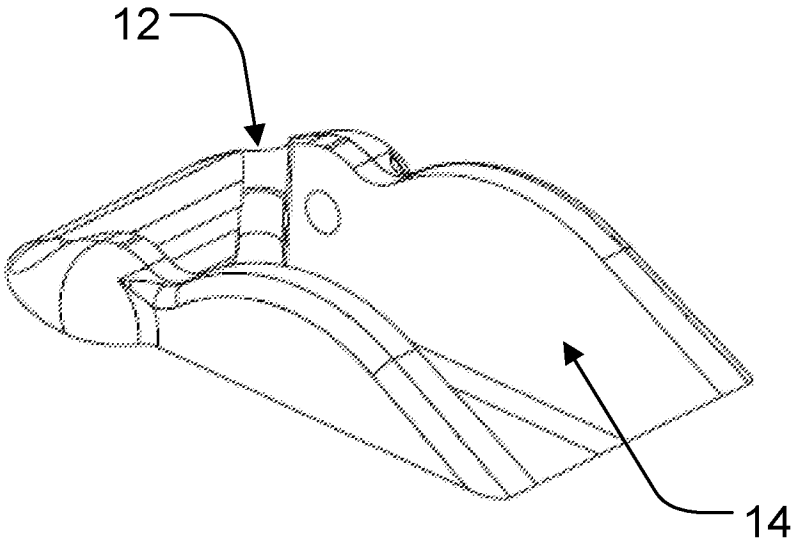
FIG. 5 illustrates the battery compartment of FIG. 4 without battery door and loop antenna.

When comparing the illustration of FIG. 8 with FIG. 4, it is understood that a hinge axis 24 of the battery door 23 separates the battery door into a main door part 25 swinging away from the battery compartment 22 when the battery door is opened and an auxiliary door part 26 swinging into the battery compartment when the battery door is opened. As seen, the auxiliary door part 26 is adapted to lock the first coupling parts 11 to the corresponding second coupling parts 12 in the closed position of the battery door 23.

As further seen in FIG. 8, the opening 14 is at least substantially rectangular and is defined by four wall parts 27, and the second coupling parts 12 have the form of recesses arranged at neighbouring corners 36 of the opening and defines insertion directions D for the respective first coupling parts 11 being oblique in relation to the extension of each wall part 27 defining the rectangular opening. Thereby, the respective first and second coupling parts 11, 12 are mutually arranged in such a way that the loop antenna 7 has to flex when the first coupling parts 11 are brought into engagement with the second coupling parts 12. Thereby, an additional locking function may be provided whereby the loop antenna 7 may be temporarily fixed in place already before moving the locking part to its locking position.

FIGS. 10 to 15 illustrate a different embodiment of the hearing aid 1. This embodiment is particularly suited for hearing aids not provided with a battery compartment. Such aids may be provided with a rechargeable battery and may be adapted to charge the battery by means of two not shown contact elements exposed in the end face 5 of the aid.

Figure 13:
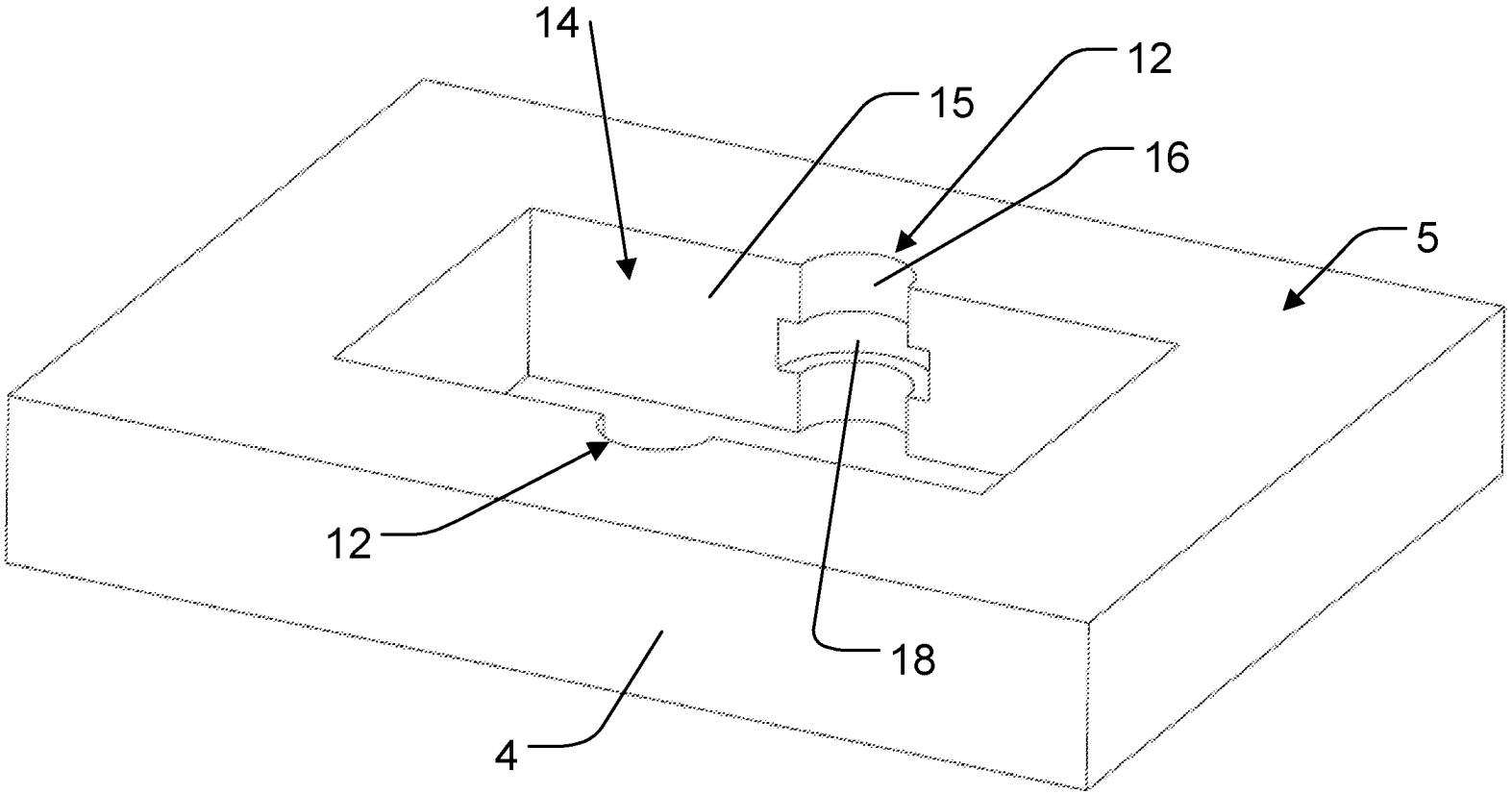
FIG. 13 is a perspective view of part of an end wall or faceplate with an opening for insertion of the loop antenna and locking part of FIG. 10, on a larger scale.
Figure 14:
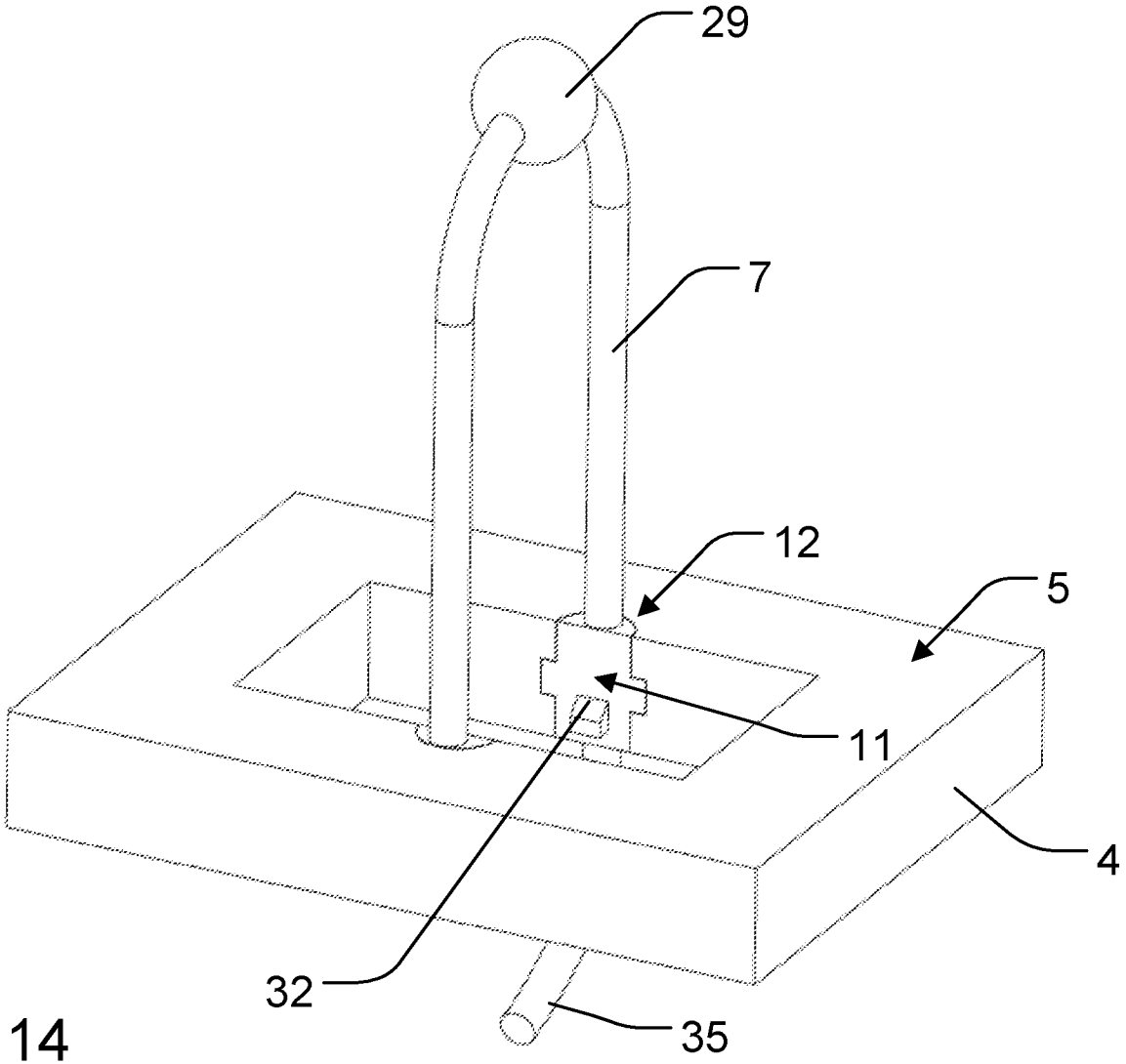
FIG. 14 is a perspective view of the part of an end wall or faceplate of FIG. 13, wherein the loop antenna of FIGS. 10 and 11 has been inserted into the opening.

FIG. 13 illustrates part of an end wall 4 in the form of a faceplate for a hearing aid 1. A rectangular opening 14 is formed in the end wall 4 and is defined by a surrounding wall 15. The second coupling parts 12 have the form of recesses in the surrounding wall 15 defining the opening 14.

Figure 11:
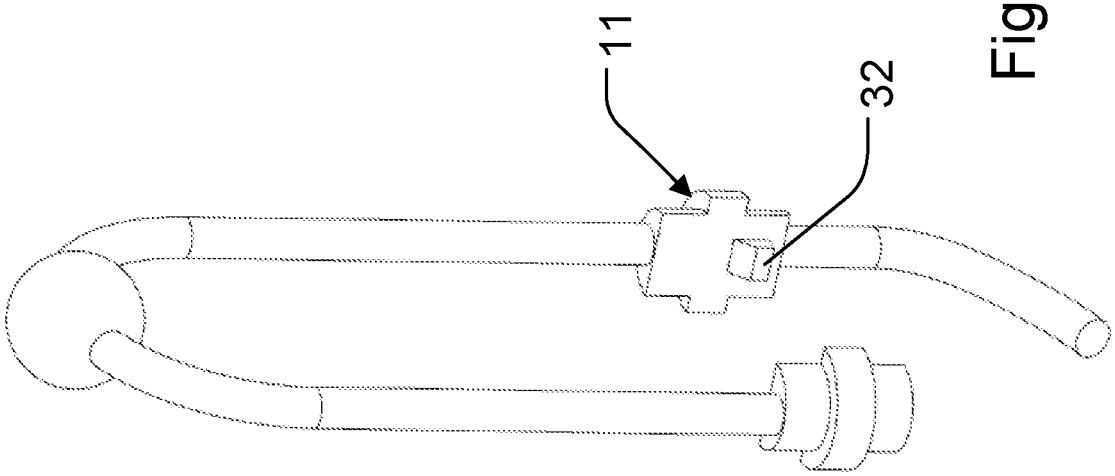
FIG. 11 is a perspective view of the loop antenna of FIG. 10, without the locking part.
Figure 10:
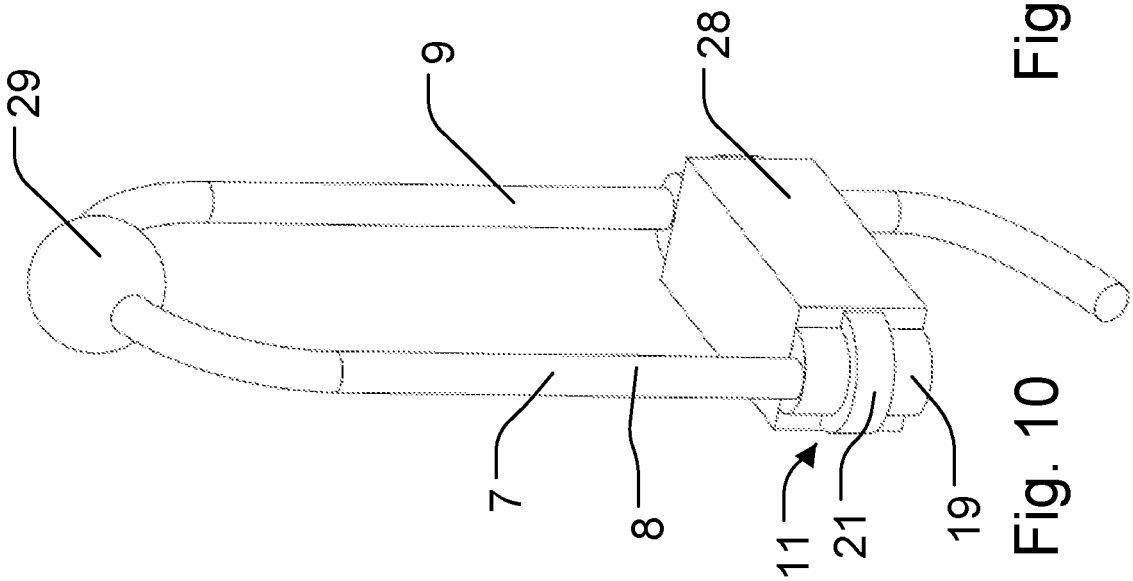
FIG. 10 is a perspective view of another embodiment of the loop antenna and locking part according to some embodiments.

Furthermore, when comparing FIGS. 10 and 11 with FIG. 13, it is seen that the recesses have the form of a partly cylindrical channel 16 having a recess 18 at a longitudinal position of the channel, and the first coupling parts 11 have a corresponding partly cylindrical form 19 with a thickening 21 corresponding to the recess 18 of the partly cylindrical channel 16. The engagement between the thickening 21 and the recess 18 may ensure that the loop antenna 7 may be fixed against displacement in the longitudinal direction of its legs 8, 9. Of course, a suitable engagement between the first coupling parts 11 and the respective second coupling parts 12 may be achieved with many other alternative geometries of the coupling parts 11, 12.

Figure 12:
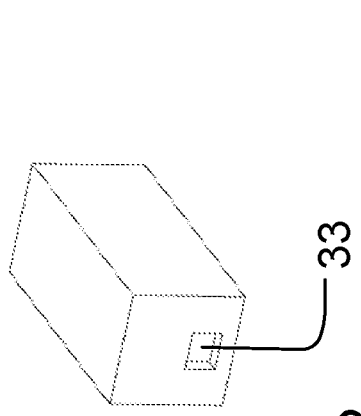
FIG. 12 is a perspective view of the locking part of FIG. 10, without the loop antenna.
Figure 15:
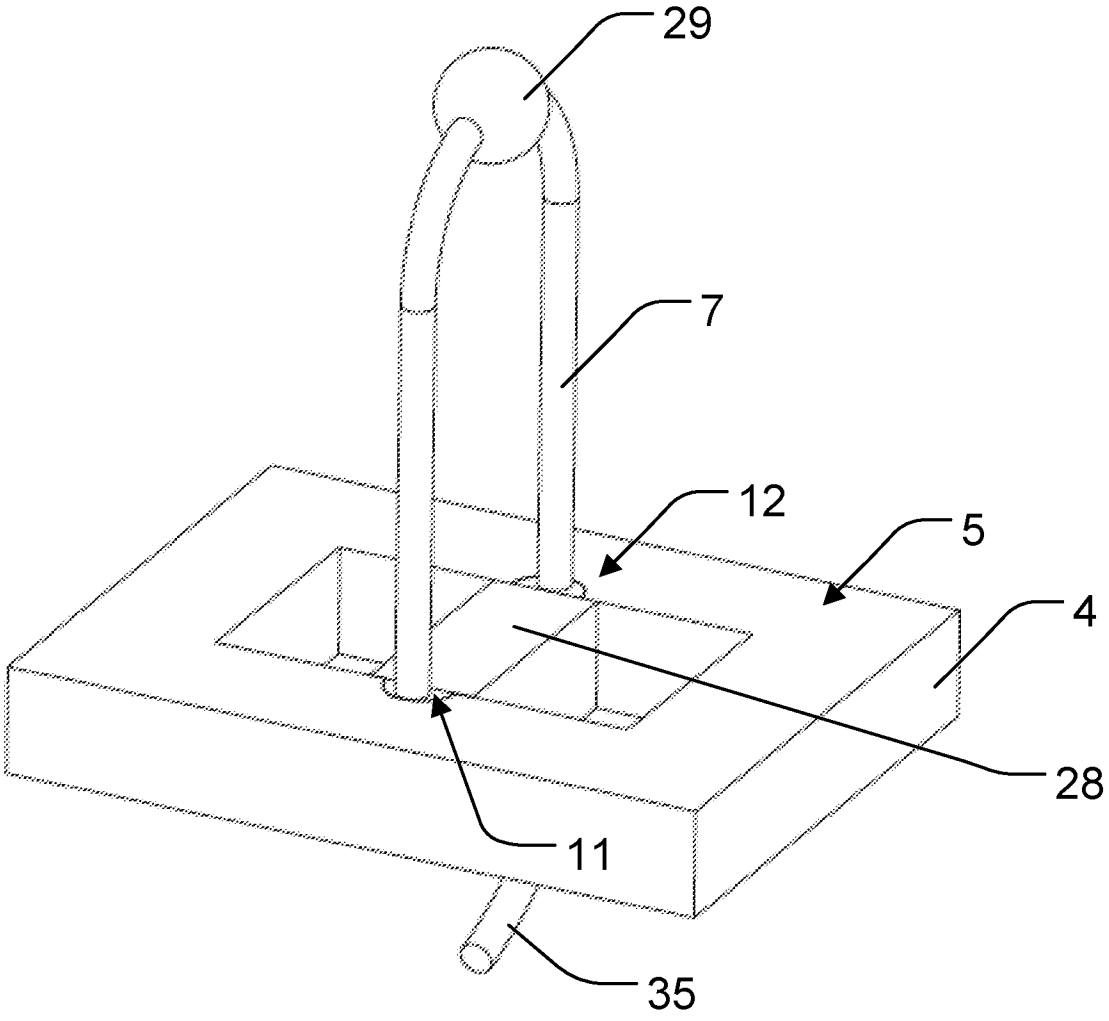
FIG. 15 is a perspective view corresponding to that of FIG. 14, wherein furthermore the locking part of FIG. 12 has been inserted into the opening.

A locking part 13 in the form of locking block 28 is illustrated in FIGS. 10, 12 and 15 and is adapted to, in the locking position of the locking block, be inserted into the opening 14 and form a snap lock with the first coupling parts 11. To form said snap lock, the first coupling parts 11 are provided with a protrusion 32 adapted to engage a recess 33 in the locking block 28. As seen in FIG. 15, in its inserted position in the opening 14, the locking block 28 only partially fills up the opening 14. Thereby, gripping the locking block 28 with the finger tips may be facilitated.

In the embodiments illustrated, the loop antenna 7 incorporates a thin wire or cable and is provided with a gripping element in the form of a thickening 29 in the form of a ball-formed element or the like, thereby facilitating handling. Furthermore, the second leg 9 of the loop antenna 7 is provided with an extension 35 in order to adapt the length of the loop antenna 7 to the frequency of the particular wireless standard.

In a method according to some embodiments, the loop antenna 7 is mounted on a hearing aid 1 by bringing the first coupling part 11 of each leg 8, 9 of the loop antenna 7 releasably into engagement with the corresponding second coupling part 12 of the hollow housing 2, and by moving the locking part 13 from the release position in which the first coupling parts 11 are free to be removed from the corresponding second coupling parts 12 to a locking position in which the first coupling parts 11 are locked to the corresponding second coupling parts 12.

Furthermore, according to a method of optimising performance of a hearing aid 1 according to some embodiments, a specific loop antenna 7 is mounted on a hearing aid 1 as described above, whereby the specific loop antenna 7 is selected from a number of different loop antennas having differing properties relating to wireless performance and/or having differing properties relating to handling of the hearing aid when gripping the loop antenna.

A number of loop antennas 7 may be available in different sizes depending on needs, such as ear canal shape, faceplate placement and faceplate size. Thereby, the efficiency of the antenna 7 and the handling properties of the aid may easily be optimised by selecting a specific antenna and mounting it to the hearing aid without use of any special tools. The choice of the specific antenna may depend on the specific wireless standard, such as for instance Bluetooth or any proprietary standard, the shape of the ear canal, the position of the hearing aid in the ear canal, and the dexterity of the user, among others. The length of a 2.4 GHz quarter wave in free space is about 31 mm, an therefore, for instance in the case of the Bluetooth wireless standard, the total length of the loop antenna 7 including a possible extension 35 should be in this range. Furthermore, the antenna may easily be exchanged for a different type at a later stage, should the need occur. The fixation of the loop antenna according to some embodiments may be robust, and there may be no need for drilling and gluing the antenna into the faceplate. The fixation may be uniform and may therefore be independent of operator skills and variation. The fixation may be fast and logic, as there may be only one way to do it. The loop antenna may be easy to replace if necessary for different reasons, such as if the antenna is broken, size requirements change, or wireless performance requirements change. The loop antenna may feature small physical space claims in faceplate.

The invention claimed is:

1. A hearing aid comprising:

a hollow housing having an outer shell configured for placement in an ear canal of a user, and an end wall having end face configured to face outwards of the ear canal when the hearing aid is placed in the ear canal;

an antenna extending from the end face and having two legs, wherein the legs of the antenna comprise respective first coupling parts configured to releasably engage corresponding second coupling parts of the hollow housing;

wireless circuitry, wherein the antenna is electrically coupled to the wireless circuitry; and a locking part movable between a locking position in which the first coupling parts are locked to the corresponding second coupling parts, and a release position in which the first coupling parts are removable from the corresponding second coupling parts;

wherein at least a portion of the locking part is configured for placement between the first coupling parts.

2. The hearing aid according to claim 1, wherein the end wall comprises an opening, and a surrounding wall at least partly surrounding the opening.

3. The hearing aid according to claim 2, wherein the second coupling parts are arranged at the surrounding wall.

4. The hearing aid according to claim 2, wherein the opening is an entrance of a battery compartment, and the locking part is a part of a battery door rotatable with respect to the end wall, wherein the battery door is swingable between a closed position and an open position.

5. The hearing aid according to claim 4, wherein a hinge axis of the battery door separates the battery door into a main door part swinging away from the battery compartment when the battery door is opened, and an auxiliary door part swinging into the battery compartment when the battery door is opened; and wherein the auxiliary door part is the locking part, and is configured to lock the first coupling parts to the corresponding second coupling parts when the battery door is in the closed position.

6. The hearing aid according to claim 2, wherein the second coupling parts comprise respective recesses defining insertion directions for the respective first coupling parts, wherein the insertion directions are oblique with respect to the surrounding wall.

7. The hearing aid according to claim 1, wherein the first and second coupling parts are arranged in such a way that the antenna has to flex when the first coupling parts are brought into engagement with the second coupling parts.

8. The hearing aid according to claim 1, wherein the locking part comprises a locking block.

9. The hearing aid according to claim 1, wherein the antenna comprises a wire or cable, and a gripping element.

10. The hearing aid according to claim 9, wherein the gripping element comprises a thickening along the wire or the cable.

11. The hearing aid according to claim 10, wherein the thickening comprises a ball.

12. The hearing aid according to claim 1, wherein the hearing aid is an in-the-ear type (ITE) hearing aid, an in-the-canal type (ITC) hearing aid, or a completely-in-the-canal type (CIC) hearing aid.

13. The hearing aid according to claim 1, wherein the antenna comprises a loop antenna.

14. The hearing aid according to claim 1, wherein the outer shell comprises a custom shell.

15. The hearing aid according to claim 1, wherein the locking part is configured to apply opposite forces towards the first coupling parts respectively.

16. A hearing aid comprising:

a hollow housing having an outer shell configured for placement in an ear canal of a user, and an end wall having end face configured to face outwards of the ear canal when the hearing aid is placed in the ear canal;

an antenna extending from the end face and having two legs, wherein the legs of the antenna comprise respective first coupling parts configured to releasably engage corresponding second coupling parts of the hollow housing;

wireless circuitry, wherein the antenna is electrically coupled to the wireless circuitry; and a locking part movable between a locking position in which the first coupling parts are locked to the corresponding second coupling parts, and a release position in which the first coupling parts are removable from the corresponding second coupling parts;

wherein the second coupling parts comprise respective recesses at different respective areas of a surrounding wall; and wherein at least a portion of the locking part is configured for placement between the first coupling parts.

17. The hearing aid according to claim 16, wherein the recesses comprise respective channels having respective protrusions, and wherein the first coupling parts has respective openings corresponding to the protrusions in the respective channels.

18. The hearing aid according to claim 16, wherein the recesses comprise respective channels having respective openings, and wherein the first coupling parts has respective protrusions corresponding to the openings in the respective channels.

19. The hearing aid according to claim 16, wherein first coupling parts are flush with the surrounding wall when the first coupling parts are placed in respective recesses at the surrounding wall.

20. The hearing aid according to claim 16, wherein the recesses are on opposite sides of an opening.

21. The hearing aid according to claim 16, wherein the locking part is configured to apply opposite forces towards the first coupling parts respectively.

22. A method of mounting an antenna on a hearing aid comprising a hollow housing having an outer shell and an end wall, the end wall having an end face configured to face outwards of an ear canal of a user when the hearing aid is placed in the ear canal, wherein the antenna has two legs with respective first coupling parts, the antenna being electrically coupled to wireless circuitry, the method comprising:

bringing the first coupling parts of the respective legs of the antenna into engagement with corresponding second coupling parts of the hollow housing; and moving a locking part from a release position in which the first coupling parts are removable from the corresponding second coupling parts, to a locking position in which the first coupling parts are locked to the corresponding second coupling parts;

wherein when the locking part is at the locking position, at least a part of the locking part is between the first coupling parts.

23. The method of claim 22, further comprising selecting the antenna from a number of different antennas having differing respective properties relating to wireless performance and/or relating to physically handling of the hearing aid.

* * * * *